US007213430B2

(12) United States Patent
Cappello et al.

(10) Patent No.: US 7,213,430 B2
(45) Date of Patent: May 8, 2007

(54) TUBE BENDING MACHINE AND ITS RIGHT AND/OR LEFT BENDING DEVICE

(75) Inventors: Serge Cappello, Taluyers (FR); Jean-Paul Chastan, Ecully (FR); Jean-Paul Bruyas, Charly (FR)

(73) Assignee: Silfax, Vourles (FR)

( * ) Notice: Subject to any disclaimer, the term of this patent is extended or adjusted under 35 U.S.C. 154(b) by 0 days.

(21) Appl. No.: 10/499,014

(22) PCT Filed: Dec. 5, 2002

(86) PCT No.: PCT/FR02/04193

§ 371 (c)(1),
(2), (4) Date: Apr. 18, 2005

(87) PCT Pub. No.: WO03/053606

PCT Pub. Date: Jul. 3, 2003

(65) Prior Publication Data

US 2005/0172690 A1 Aug. 11, 2005

(30) Foreign Application Priority Data

Dec. 20, 2001 (FR) ..... 01 16593

(51) Int. Cl.
*B21D 7/04* (2006.01)

(52) U.S. Cl. ..... 72/149; 72/157

(58) Field of Classification Search ..... 72/149, 72/157

See application file for complete search history.

(56) References Cited

U.S. PATENT DOCUMENTS 4,038,853 A 8/1977 Schwarze
4,416,136 A 11/1983 Schwarze
4,843,859 A 7/1989 Togoshi
5,495,740 A * 3/1996 Schwarze ..... 72/149
5,499,522 A 3/1996 Schwarze
5,950,474 A * 9/1999 George et al. ..... 72/159

FOREIGN PATENT DOCUMENTS

EP 0 990 471 4/2000

* cited by examiner

*Primary Examiner*—Derris H. Banks
*Assistant Examiner*—Teresa M. Bonk
(74) *Attorney, Agent, or Firm*—Dowell & Dowell, P.C

(57) ABSTRACT

A tube-bending machine including a bending arm that is provided with a jaw support that moves horizontally in a direction of a bending head, whereby said jaw support is integral with a clamping jaw assembly that comprises at least one jaw for bending a tube clockwise and at least one jaw for bending a tube counterclockwise, wherein the jaws are fixed to one another. A bending roller is fixed to the bending arm and comprises at least one jaw for bending the tube clockwise and at least one jaw for bending the tube counterclockwise, whereby said jaws of the bending roller are laterally offset relative to one another and on both sides of a vertical axis XX' of the bending head. A first strip support is also provided having at least one jaw to clamp the tube as it is being bent clockwise and a second strip support that includes at least one jaw to clamp the tube as it is being bent counterclockwise.

13 Claims, 5 Drawing Sheets

TUBE BENDING MACHINE AND ITS RIGHT AND/OR LEFT BENDING DEVICE

BACKGROUND OF THE INVENTION

1. Field of the Invention

This invention relates to a tube-bending machine and more particularly to a bending device that allows the bending of a tube either to the left in a so-called clockwise direction or to the right in a counterclockwise direction.

During bending in a clockwise direction, the bending arm moves from the right to the left around the bending head.

During bending in a counterclockwise direction, the bending arm moves from the left to the right around the bending head.

2. Description of the Related Art

According to European Patent EP 649 687, a tube-bending machine that comprises a hinged bending template, a bending arm that can pivot by 180° degrees around the axis of the bending template and a clamping jaw that is supported by the bending arm is known.

The bending template has two template portions placed one above the other, whereby one is designed for bending the tube to the right and the other for bending the tube to the left.

The clamping jaw is designed both for bending to the right and for bending to the left. The clamping jaw respectively has a jaw element on each side of a plane transversal to the clamping jaw and containing the axis of the bending template.

SUMMARY OF THE INVENTION

The lower jaw element of the clamping jaw acts with the lower template portion while the upper jaw element acts with the upper template portion for clamping a tube portion.

The object of the tube-bending machine according to this invention is to allow either the bending to the left or the bending to the right of the same tube by means of a bending roller that is attached to the bending arm.

The tube-bending machine according to this invention comprises:

- a fixed frame that has, along its longitudinal axis, a guide rail on which slides a movable carriage that is integral with a rod, making it possible, by means of an internal clamping mandrel, to guide a tube to be bent and to immobilize said tube in rotation and translation,
- at one of its ends a bending head, a bending roller and a bending arm that pivots around vertical axis XX' of the bending head for the formation of the tube,
- a bending arm that is provided with a jaw support that moves horizontally in the direction of the bending head, whereby said jaw support is integral with a clamping jaw that comprises at least one jaw for the bending in a clockwise direction of the tube and at least one jaw for bending in a counterclockwise direction of the tube, whereby said jaws are fixed to one another,
- a bending roller that is fixed to the bending arm and that comprises at least one jaw for the bending in a clockwise direction of the tube and at least one jaw for the bending in a counterclockwise direction of the tube, whereby said jaws are laterally offset relative to one another and on both sides of vertical axis XX' of the bending head,
- a first strip support that comprises at least one jaw to clamp the tube as it is being bent clockwise,

- and a second strip support that comprises at least one jaw to clamp the tube as it is being bent counterclockwise.

The tube-bending machine according to this invention comprises a clamping jaw that comprises at least two jaws that are laterally offset relative to one another.

The tube-bending machine according to this invention comprises a clamping jaw that comprises at least two jaws that are located one above the other and that are separated by a housing.

The tube-bending machine according to this invention comprises in the clamping jaw a housing that has a height that is higher than that provided for a jaw.

The tube-bending machine according to this invention comprises a clamping jaw that comprises three jaws that are laterally offset relative to one another to form, between the jaws that are located one above the other, a housing.

The tube-bending machine according to this invention comprises a bending arm that comprises a bending roller that pivots at the same time as the latter around vertical axis XX' of the bending head as the tube is being bent to the right or left.

The tube-bending machine according to this invention comprises a bending roller that comprises at least two jaws that are laterally offset to one another and on both sides of vertical axis XX' of the bending head.

The tube-bending machine according to this invention comprises a first strip support that comprises at least one jaw and at least one housing.

The tube-bending machine according to this invention comprises a first strip support whose number of jaws depends on the number of jaws that are integral with the clamping jaws and the bending roller making it possible to bend the tube to the left or clockwise.

The tube-bending machine according to this invention comprises a second strip support whose number of jaws depends on the number of jaws that are integral with the clamping jaw and the bending roller making it possible to bend the tube counterclockwise.

The tube-bending machine according to this invention comprises a second strip support of which each jaw is positioned on the same level as that of the corresponding housing of the clamping jaw.

The tube-bending machine according to this invention comprises a second strip support that comprises at least one jaw and at least one housing.

The tube-bending machine according to this invention comprises a second strip support that comprises a housing above and below the jaw.

The tube-bending machine according to this invention comprises simultaneous and inverted driving means of the first and second strip supports in terms of a horizontal translatory motion in the direction of the tube.

BRIEF DESCRIPTION OF THE DRAWINGS

The following description with regard to the accompanying drawings, given by way of non-limiting examples, will make it possible to better understand the invention, the characteristics that it exhibits and the advantages that it is likely to ensure.

DESCRIPTION OF THE PREFERRED EMBODIMENT

Figure 1:
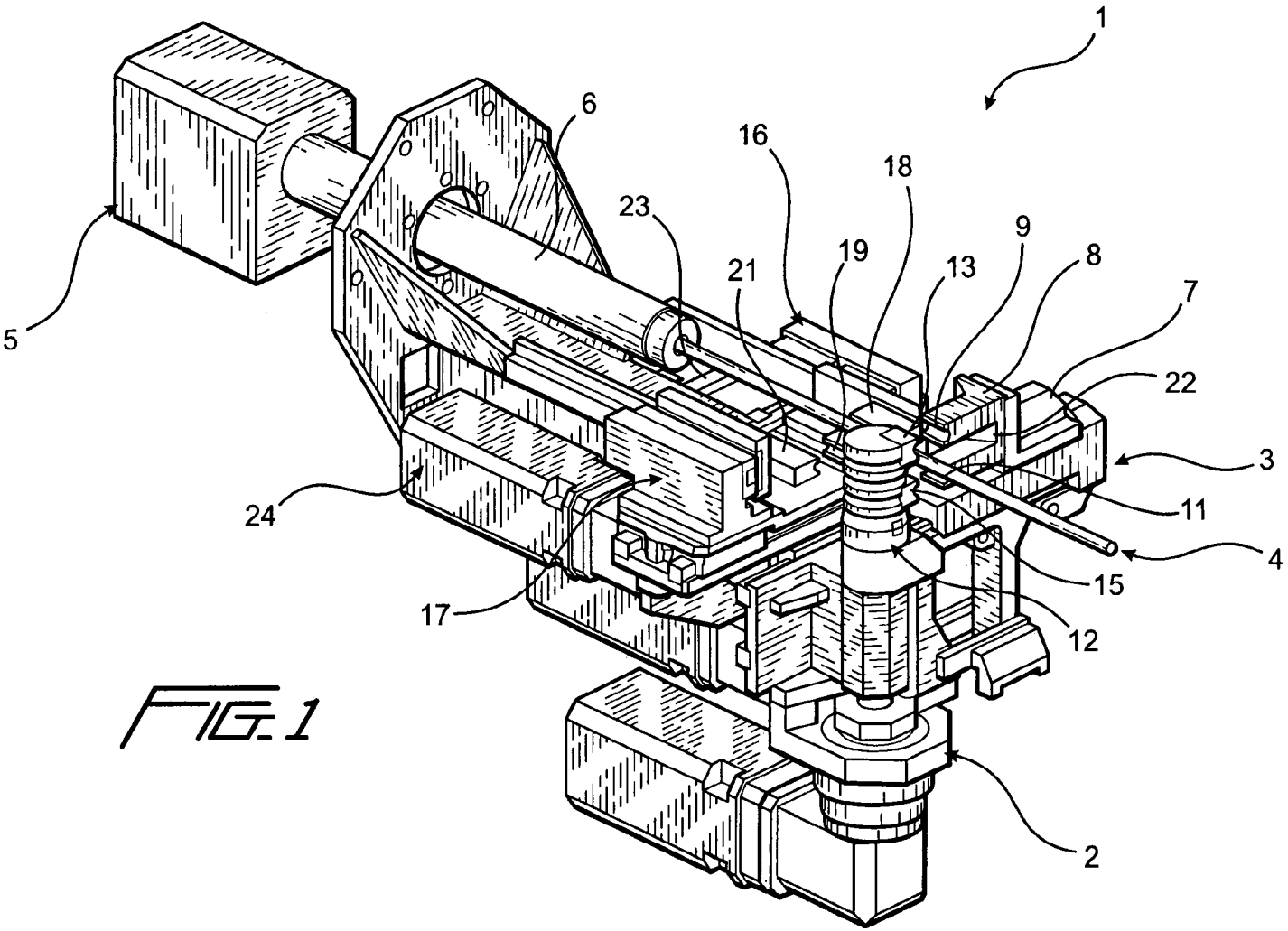
FIG. 1 is a perspective view that illustrates a tube-bending machine according to this invention.
Figure 2C:
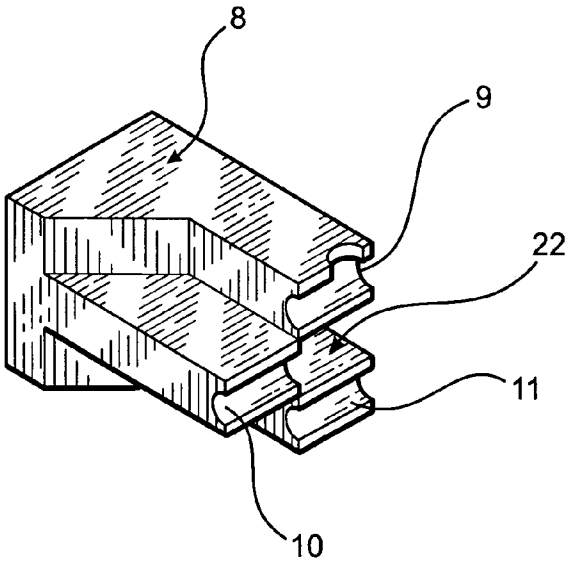
FIGS. 2*a* to 2*c* are views that show in detail the clamping jaw and the bending roller of the bending machine according to this invention.
Figure 2B:
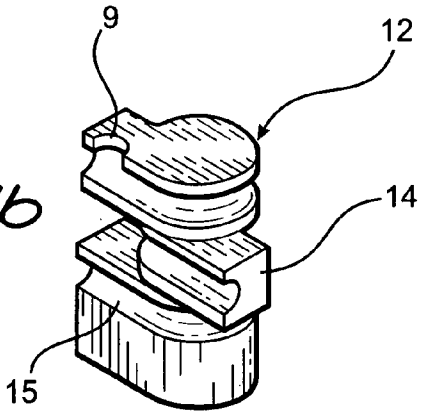
Figure 2A:
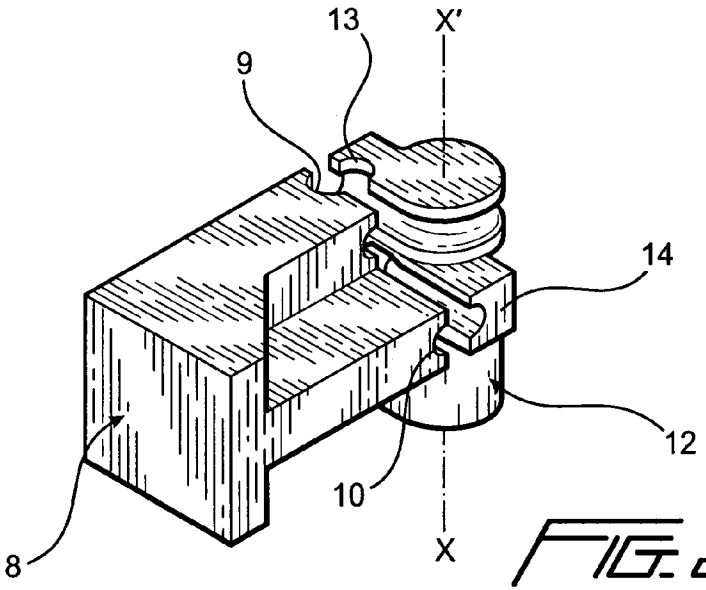

Shown in FIGS. 1 and 2*a* to 2*c* is a bending machine 1 whose fixed frame at one of its ends carries a bending head 2 around which pivots a bending arm 3 for the formation of a tube 4 either in a clockwise direction or in a counterclockwise direction.

During bending in a clockwise direction, bending arm 3 moves from the right to the left around bending head 2.

During bending in a counterclockwise direction, bending arm 3 moves from the left to the right around bending head 2.

The fixed frame comprises, along its longitudinal axis, a guide rail, not shown, on which slides a movable carriage 5 that approaches and moves away from bending head 2 by means of a geared motor.

Movable carriage 5 comprises a rod or a drum 6 that makes it possible, by means of an internal clamping mandrel, to guide tube 4 to be bent and to immobilize said tube in rotation and translation.

Bending arm 3 comprises a jaw support 7 that moves horizontally in the direction of bending head 2.

Jaw support 7 is integral with a clamping jaw 8 that comprises various jaw profiles 9, 10, and 11 whose number can vary based on the number of bending motions to the right and/or left that it is necessary to carry out on tube 4.

Jaws 9, 10 and 11 are integral with clamping jaw 8 and fixed relative to one another.

Based on the number of jaws, the latter are placed on clamping jaw 8 so that they are laterally offset relative to one another to constitute at least one housing 22 between two jaws.

This housing 22 is of a slightly greater height than the one provided for a bending jaw.

It is noted, in the sample embodiment according to this invention, that clamping jaw 8 comprises three jaws 9, 10 and 11 that are laterally offset relative to one another to form a housing 22 between jaws 9 and 11 that are located one above the other.

Bending arm 3 comprises a bending roller 12 that pivots at the same time as the latter around vertical axis XX' of bending head 2 as tube 4 is being bent to the right or left. Thus, bending roller 12 is fixed in rotation relative to bending arm 3.

Bending roller 12 consists of various jaw profiles 13, 14 and 15 whose number may vary based on the number of bending motions to the right and/or left that it is necessary to carry out on tube 4. It is noted that the number of jaws on bending roller 12 is equivalent to the one provided on clamping jaw 8.

Jaws 13, 14 and 15 are integral with bending roller 12 and fixed relative to one another.

It is noted that jaws 13, 14 and 15 of bending roller 12 are laterally offset relative to one another and on both sides of vertical axis XX' of bending head 2.

The various profiles of jaws 13, 14 and 15 of bending roller 12 are respectively placed opposite jaws 9, 10 and 11 of clamping jaws 8 to carry out the bending of tube 4.

It is noted that the profile of jaws 9, 11 of clamping jaw 8 and the profile of jaws 13, 15 of bending roller 12 make it possible to carry out the bending of tube 4 in a clockwise direction.

In contrast, the profile of jaw 10 of clamping jaw 8 and that of jaw 14 of bending roller 12 make it possible to carry out the bending of tube 4 in a counterclockwise direction.

Bending machine 1 comprises, at bending head 2 and on both sides of tube 4 that is to be bent, a first strip support 16 and a second strip support 17 that are placed opposite one another and that move respectively in terms of a horizontal translatory motion in the direction of tube 4 and in terms of a horizontal translatory motion in the direction of bending roller 12.

First strip support 16 moves in a horizontal translatory motion in the direction of bending head 2, whereby bending arm 3 carries bending roller 12 via a drive device 23, which can be a hydraulic or electric jack or any other motion transmission system.

Second strip support 17 moves in a horizontal translatory motion in the direction of bending head 2, whereby bending arm 3 carries bending roller 12 via a drive device 24, which can be a hydraulic or electric jack or any other motion transmission system.

First and second strip supports 16 and 17 are moved in a horizontal translatory motion in the direction of tube 4 for the purpose of its clamping and its immobilization via a drive means that is unique for the two strip supports 16, 17.

Thus, when first strip support 16 is moved in the direction of tube 4 for its immobilization, second strip support 17 automatically moves away from said tube. Conversely, when second strip support 17 approaches tube 4, first strip support 16 moves away from the latter.

First strip support 16 comprises two jaws 18, 19 that come to rest against tube 4 to be able to accompany and maintain said tube 4 during bending in a clockwise direction.

The number of jaws provided on first strip support 16 depends on the number of jaws that are integral with clamping jaw 8 and bending roller 12 making it possible to bend tube 4 clockwise.

It is noted that jaws 18 and 19 of first strip support 16 are separated from one another by a housing 20 whose height d corresponds to a height that is slightly greater than that of jaws 10, 14 of clamping jaw 8 and bending roller 12.

Housing 20 of first strip support 16 is suitable for receiving jaws 10 and 14 of clamping jaw 8 and bending roller 12 to be able to carry out bending of tube 4 clockwise.

Actually, during the bending of tube 4 clockwise, first strip support 16 moves in the direction of bending roller 12 that is integral with jaw 14 at this level.

Thus, strip support 16 comprises at least one jaw 18, 19 and at least one housing 20 whose number depends on the number of jaws that make it possible to bend tube 4 counterclockwise.

Second strip support 17 comprises a jaw 21 that comes to rest against tube 4 to be able to accompany and maintain said tube 4 as it is being bent to the right.

When second strip support 17 comprises a jaw 21, a housing 25 that is suitable for receiving jaws 9, 11 and 13, 15 of clamping jaw 8 and bending roller 12 to be able to carry out the bending of tube 4 counterclockwise is provided above and below said jaw.

Thus, strip support 17 comprises at least one jaw 21 and at least one housing 25 whose number depends on the number of jaws that make it possible to bend tube 4 clockwise.

Also, the number of jaws provided on second strip support 17 depends on the number of jaws that are integral with clamping jaw 8 and bending roller 12 making it possible to bend tube 4 counterclockwise.

Bending head 2 comprises translation means to be able to move horizontally and vertically relative to the fixed frame, i.e., in the directions that are in planes perpendicular to the one containing the longitudinal axis of machine 1 or of the fixed frame, which is generally embodied by tube 4.

Figure 3:
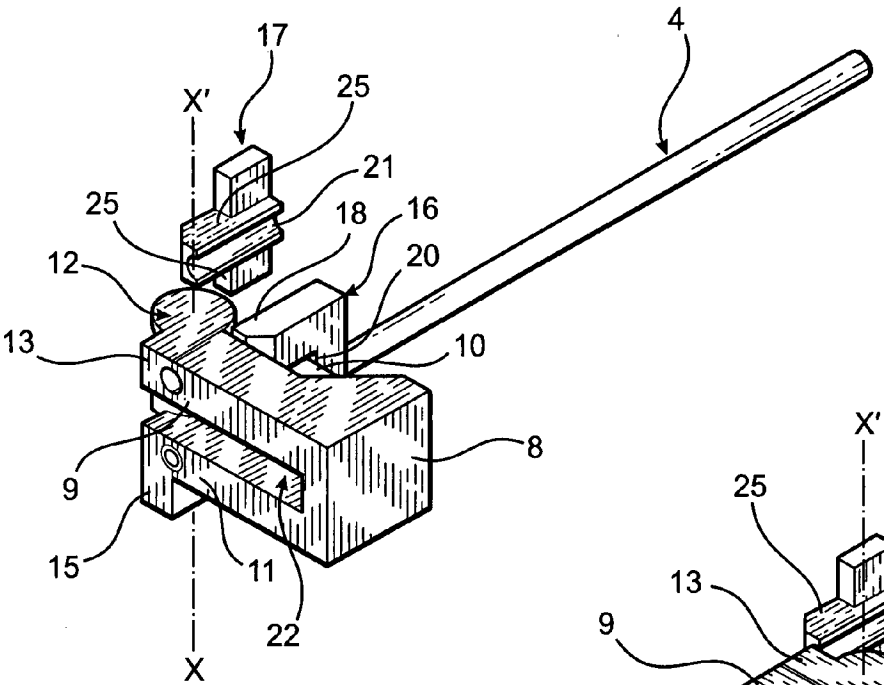
FIGS. 3 to 6 are perspective views that show the device for bending a tube clockwise according to this invention.
Figure 4:
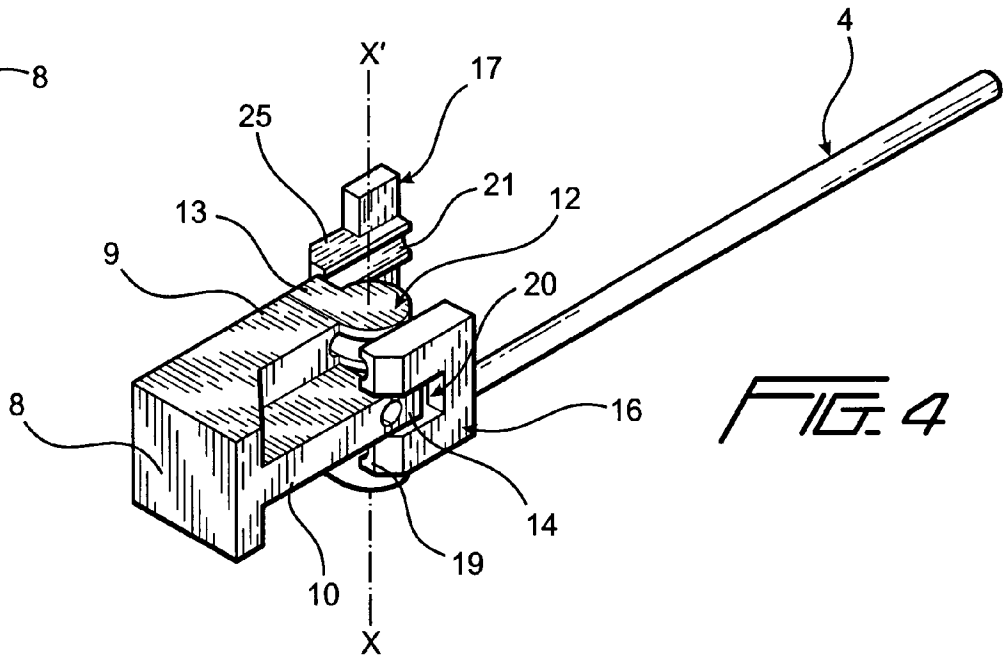

Shown in FIGS. 3 and 4, for example, is the first bending of tube 4 clockwise that is obtained by means of jaw 11 of clamping jaw 8, jaw 15 of bending roller 12, and jaw 19 of first strip support 16.

It is noted that to carry out a bending of tube 4 clockwise, the latter should be to the right of vertical axis XX' of bending head 2 according to the representation of FIG. 1.

The bending of tube 4 clockwise is carried out when bending arm 3 and bending roller 12 pivot around bending head 2 according to a clockwise rotation relative to vertical axis XX' of said head.

During the rotation of bending arm 3 and bending roller 12 around bending head 2, jaw 19 of strip support 16 is moved in a horizontal translatory motion in the direction of bending roller 12 to make it possible to clamp tube 4.

This accompaniment of tube 4 by strip support 16 is obtained by means of housing 20 that is provided between jaws 18 and 19 that makes it possible to receive jaw 10 of bending arm 3 and jaw 14 of bending roller 12.

Actually, housing 20 of first strip support 16 makes possible the release of jaws 10, 14, making possible the bending in a counterclockwise direction during the rotation in clockwise direction of bending arm 3 and bending roller 12 around axis XX' of bending head 2.

Figure 5:
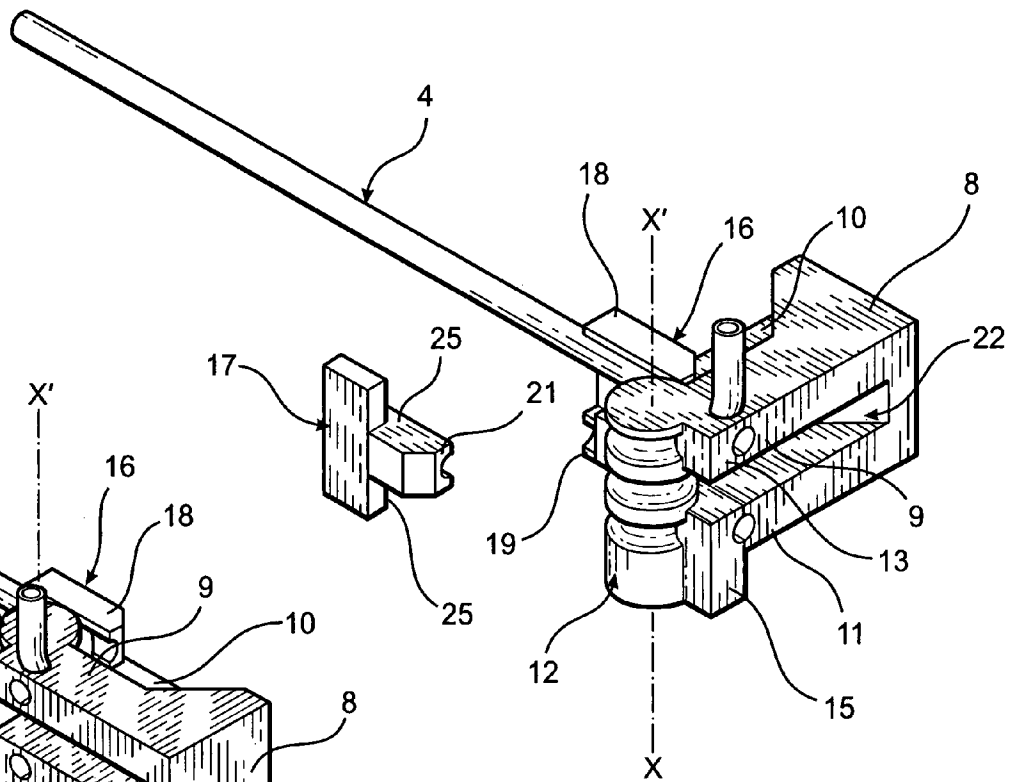
Figure 6:
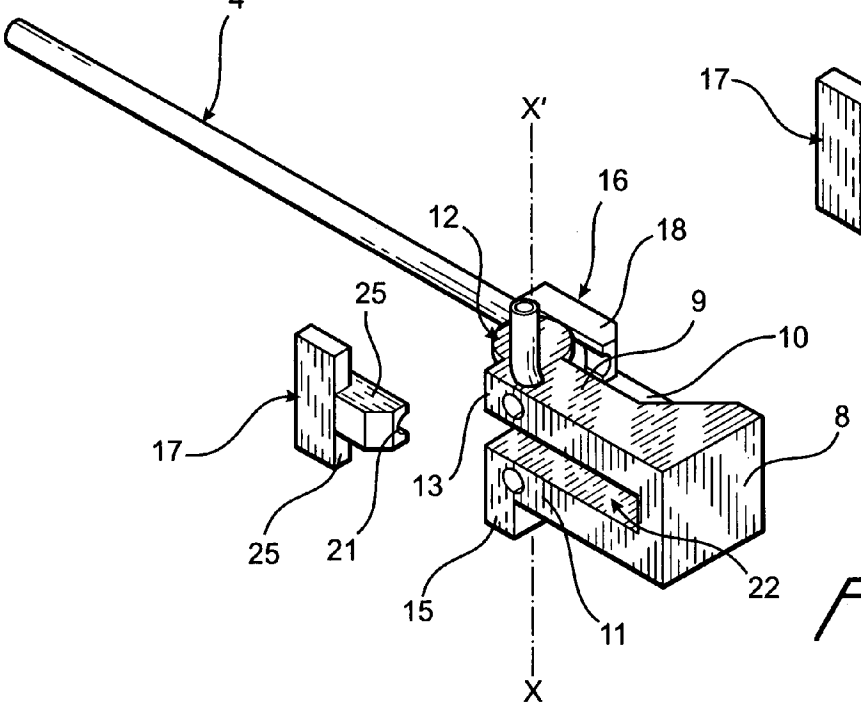

Shown, for example, in FIGS. 5 and 6 is the second bending of tube 4 clockwise direction that is obtained by means of jaw 9 of clamping jaw 8, jaw 13 of bending roller 12, and jaw 18 of first strip support 16.

The second bending in a clockwise direction is carried out after a translation and a rotation of tube 4 around its longitudinal axis so as to initiate the first bending of the bending jaws.

The second bending of tube 4 clockwise is carried out when bending arm 3 and bending roller 12 pivot around bending head 2 according to a clockwise rotation relative to vertical axis XX' of said head.

During the rotation of bending arm 3 and bending roller 12 around bending head 2, jaw 18 of strip support 16 is moved in a horizontal translatory motion in the direction of bending roller 12 to make it possible to clamp tube 4.

This accompaniment of tube 4 by strip support 16 is obtained by means of housing 20 that is provided between jaws 18 and 19 that receives jaw 10 of bending arm 3 and jaw 14 of bending roller 12.

Actually, housing 20 of first strip support 16 makes possible the release of jaws 10, 14 making possible the bending in a counterclockwise direction during rotation in counterclockwise direction of bending arm 3 around axis XX' of bending head 2.

Figure 8:
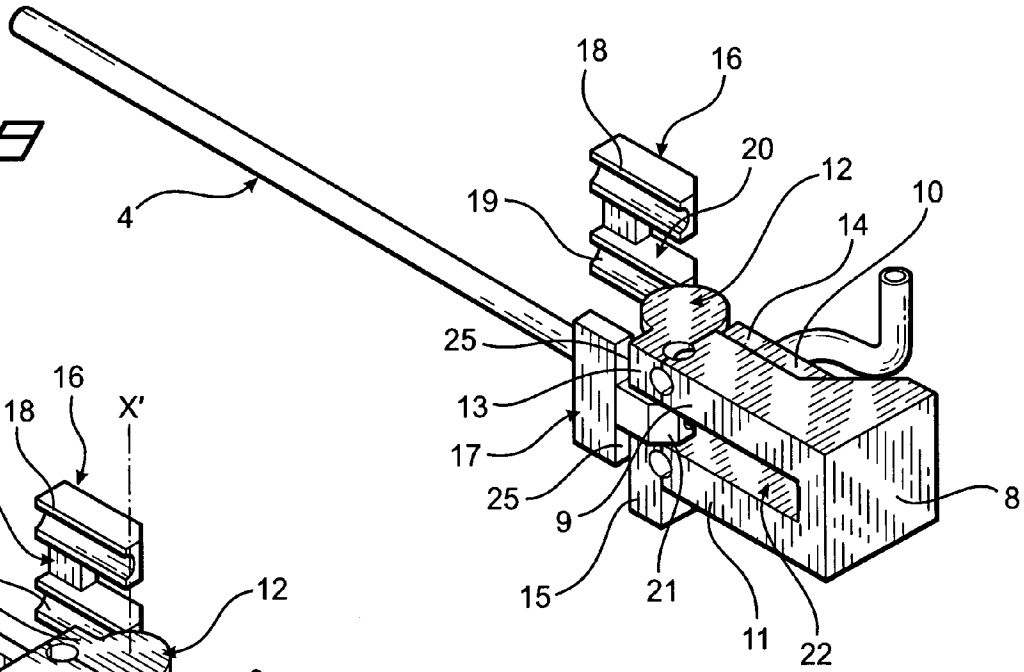
FIGS. 7 and 8 are perspective views that show the device for bending a tube counterclockwise according to this invention.
Figure 7:
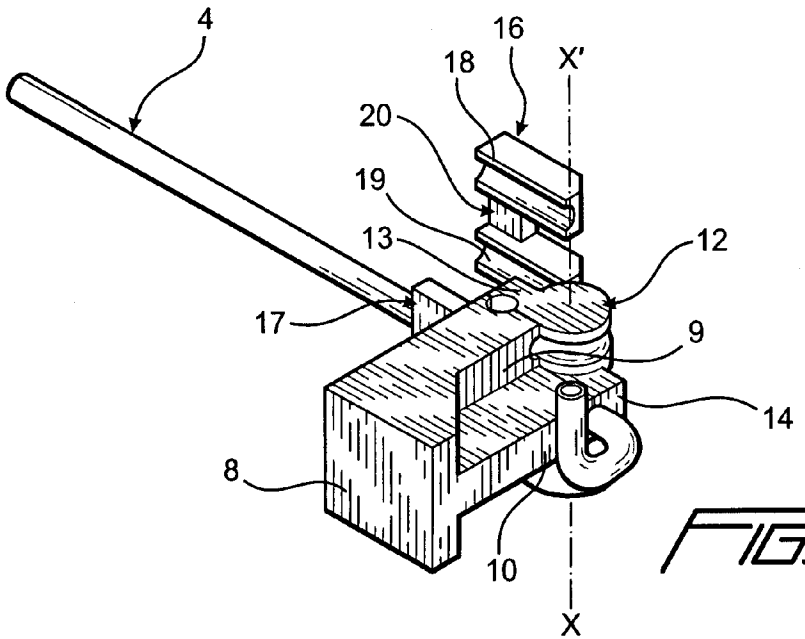

Illustrated in FIGS. 7 and 8 is a bending of tube 4 counterclockwise that is obtained by means of jaw 10 of clamping jaw 8, jaw 14 of bending roller 12, and jaw 21 of second strip support 17.

The bending in a counterclockwise direction is carried out after a translation and a rotation of tube 4 around its longitudinal axis so as to initiate the first two bending motions in a clockwise direction of the bending jaws.

It is noted that to carry out a bending of tube 4 counterclockwise, the latter should be to the left of vertical axis XX' of bending head 2.

To do this, bending head 2 and bending arm 3 that carry bending roller 12 are moved in a vertical direction downward relative to the frame of bending machine 1. This vertical translation makes it possible to release tube 4 from jaw support 8 and bending roller 12.

Bending arm 3 and bending roller 12 are driven in rotation around bending head 2 so as to be positioned to the left of vertical axis XX'.

Bending head 2 and bending arm 3 are then moved vertically upward to return to the level of tube 4 so that the latter is positioned to the left of axis XX' of bending head 2 and between jaws 10 and 14 of clamping jaw 8 and bending roller 12.

The bending of tube 4 counterclockwise is carried out when bending arm 3 and bending roller 12 pivot around bending head 2 according to a rotation from left to right relative to vertical axis XX' of said head.

During the rotation of bending arm 3 and bending roller 12 around bending head 2, jaw 21 of strip support 17 is moved in a horizontal translatory motion in the direction of bending roller 12 to make it possible to clamp tube 4.

This accompaniment of tube 4 by strip support 17 is obtained by means of housing 22 that is provided between jaws 9 and 11 of clamping jaw 8 that receives jaw 21 of strip support 17.

This accompaniment of tube 4 by strip support 17 is also obtained by means of housings 25 provided above and below jaw 21 so as to receive respectively jaws 9, 13 and 11, 15 of clamping jaw 8 and bending roller 12.

Thus, housing 22 of clamping jaw 8 and housings 25 of strip support 17 make possible the release of jaws 9, 13; 11, 15 and 21 that thus make possible the bending in a counterclockwise direction of tube 4 by means of jaws 10 and 14 of clamping jaw 8 and bending roller 12 that are driven in a rotation in counterclockwise direction around axis XX' of bending head 2.

Bending machine 1 can carry out other bending motions of tube 4 counterclockwise if clamping jaw 8 and bending roller 12 comprised other jaws that make this type of bending possible.

Further, it should be understood that the preceding description was given only by way of example and that it in no way limits the scope of the invention if the same goal could be achieved by replacing the above-described embodiment details with any other equivalent items.

The invention claimed is:

1. Tube-bending machine that comprises a fixed frame that has a carriage movable relative to said frame, means carried by said carriage to guide a tube to be bent and to immobilize the tube in rotation and translation, a bending head, a bending roller and a bending arm that both pivot about an axis (XX') of said bending head in order to bend the tube clockwise and counterclockwise, said bending arm including a jaw support that moves horizontally in a direction of said bending head, said jaw support having a clamping jaw including at least one first jaw for engaging and bending the tube (4) clockwise and at least one second jaw for engaging and bending the tube counterclockwise, said first and second jaws being fixed to one another, said bending roller being fixed to said bending arm and including at least one third jaw for engaging and bending the tube clockwise and at least one fourth jaw for engaging and bending the tube counterclockwise, said third and fourth jaws being laterally offset relative to one another on opposite sides of said axis (XX') of said bending head, said bending arm and said bending roller being pivoted at the same time about the axis (XX') of said bending head as the tube is being bent clockwise or counterclockwise, a first strip support that includes at least one jaw that engages the tube as it is being bent clockwise, and a second strip support that includes at least one jaw that is oriented in opposing relationship with said at least one jaw of said first strip support that engages the tube as it is being bent counterclockwise.

2. Tube-bending machine according to claim 1, wherein said first and second jaws of said clamping jaw are laterally offset relative to one another.

3. Tube-bending machine according to claim 1, wherein said first and second jaws of said clamping jaw are located one above the other and are separated by a housing.

4. Tube-bending machine according to claim 3, wherein said housing has a height that is greater than a height of one of said first and second laws.

5. Tube-bending machine according to claim 1, wherein clamping jaw includes two first jaws that are laterally offset relative to said at least one second jaw and that are located one above the other, and a housing formed between said two first jaws.

6. Tube-bending machine according to claim 1, wherein said third and fourth jaws of said bending roller that are laterally offset relative to one another and on both sides of said axis XX'of said bending head.

7. Tube-bending machine according to claim 1, wherein said first strip support includes at least two jaws having at least one housing there between.

8. Tube-bending machine according to claim 7, wherein a number of said at least two jaws of said first strip support depends on a number of first jaws that are integral with said clamping jaw and said third jaws of said bending roller that are used to bend the tube clockwise.

9. Tube-bending machine according to claim 1, wherein the number of jaws provided on said second strip support depends on a number of second jaws that are integral with said clamping jaw and a number of fourth jaws of said bending roller that are used to bend the tube counterclockwise.

10. Tube-bending machine according to claim 1, wherein each jaw of said second strip support is positioned so as to be receivable within a housing of an adjacent clamping jaw.

11. Tube-bending machine according to claim 1, wherein said second strip support includes at least one housing for receiving one of said first and second jaws of said clamping jaw.

12. Tube-bending machine according to claim 11, wherein said second strip support includes a housing above and below said at least one jaw thereof.

13. Tube-bending machine according to claim 1, including driving means for simultaneously moving said first and second strip supports in opposite directions relative to the tube such that as one of said first and second strip supports is moved toward the tube, the other is moved away from the tube.

* * * * *